United States Patent [19]

Hammon

[11] Patent Number: 5,026,580

[45] Date of Patent: Jun. 25, 1991

[54] LAMINATED GOLF MAT

[75] Inventor: Mark A. Hammon, Woodward, Iowa

[73] Assignee: AGR Inc., Perry, Iowa

[21] Appl. No.: 557,592

[22] Filed: Jul. 25, 1990

Related U.S. Application Data

[63] Continuation-in-part of Ser. No. 328,232, Mar. 24, 1989, abandoned, which is a continuation-in-part of Ser. No. 202,398, Jun. 6, 1988, Pat. No. 4,844,470.

[51] Int. Cl.[5] ..... A63B 69/36

[52] U.S. Cl. ..... 428/17; 428/95; 273/195 A; 156/72

[58] Field of Search ..... 273/195 R, 195 A, 195 B, 273/176 J, 196 R, 197 R, 197 A, 198; 428/17, 95, 93; 156/72

[56] References Cited

U.S. PATENT DOCUMENTS

| | | | |
|---|---|---|---|
| 3,599,982 | 8/1971 | Elesh | 273/195 A |
| 3,661,687 | 5/1972 | Spinney, Jr. et al. | 273/176 J |
| 3,870,314 | 3/1975 | Bertucci | 273/175 R |
| 4,387,896 | 6/1983 | O'Brien | 273/195 A |
| 4,617,208 | 10/1986 | Cadenhead | 428/17 |
| 4,844,470 | 7/1989 | Hammon | 273/195 A |
| 4,902,541 | 2/1990 | Martino | 428/17 |

FOREIGN PATENT DOCUMENTS

| | | | |
|---|---|---|---|
| 2107593 | 5/1983 | United Kingdom | 273/195 B |

*Primary Examiner*—George J. Marlo

*Attorney, Agent, or Firm*—Zarley, McKee, Thomte, Voorhees & Sease

[57] ABSTRACT

A golf mat of grass-like material includes top and bottom pads each of which includes belting material which substantially strengthens them and protects the base mat from damage from golf clubs striking it. The golf tee extends only through the top pad and not through the base mat and the belting material of the top pad prevents any enlargement of the hole through the top pad which includes felt carpet which also gives a grass-like appearance. The top pad is loosely secured to the base mat and may be raised at its center for replacement of the tee and the top pad absorbs energy from the golf club due to its ability to move relative to the base mat when it is struck. The pad may be replaced through operation of the bolts at its opposite ends.

In an alternate embodiment the turf layer includes filaments of yarn such as tufts partially exposed on the bottom side adjacent fabric-like material exposed on the top side of the layer of belting material. Adhesive is applied to these two surfaces forms chemical and mechanical bonds therebetween by the adhesive penetrating the two layers and encapsulating the exposed tufts and fabric material.

9 Claims, 6 Drawing Sheets

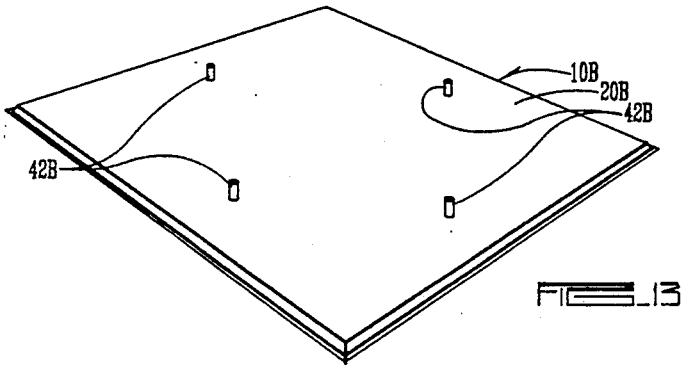
FIG. 13
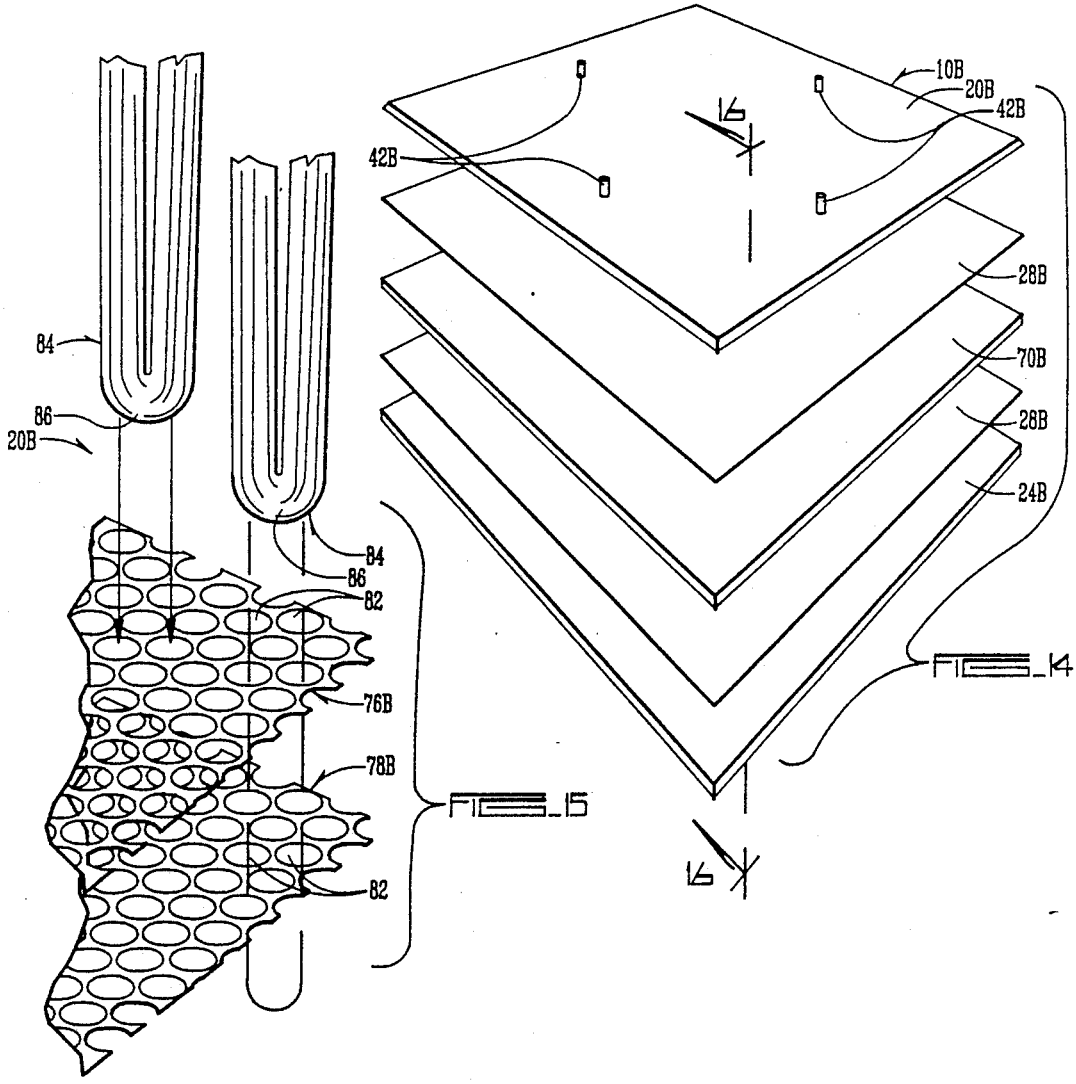
FIG. 14
FIG. 15

LAMINATED GOLF MAT

CROSS REFERENCE TO RELATED APPLICATION AND PATENT

This application is a continuation-in-part of patent application Ser. No. 328,232 filed Mar. 24, 1989 and entitled GOLF MAT, now abandoned, which was a continuation-in-part of U.S. patent Ser. No. 202,398, filed Jun. 6, 1988, now U.S. Pat. No. 4,844,470 issued July 4, 1989, and titled GOLF MAT.

BACKGROUND OF THE INVENTION

Golf mats used at driving ranges suffer considerable damage through ordinary, unintentional but abusive use. The golfer practicing his shots from the tee will often hit the mat with his club rather than cleanly hitting the ball off of the tee. The substantial usage the golf mat receives gives the mat a very short lifetime because of the damage done to the mat in the area of the tee.

Another problem with conventional golf mats is that they will delaminate along the peripheral edges. Accordingly, what is needed is a golf mat which has been substantially strengthened and is resistant to unintentional abusive wear and tear. The mat should include parts which may be readily replaced as they wear out saving replacing the entire mat. Protection should be provided on the edges of the mat to prevent separation of the laminations.

This invention addresses another specific problem that exists with golf mats. The golfer expects the mat to simulate the grass on the golf course in both looks and feel. Therefore, artificial turf needs to be used on a cushion-type surface. The problem is that the golf club striking the artificial turf on the cushion destroys the cushion and delaminates the turf from the cushion. What is needed is a means and method for bonding the artificial turf to a ground-like cushion to as effectively as possible simulate actual golf course conditions.

SUMMARY OF THE INVENTION

The golf mat of this invention is comprised of three components which are bolted together. A base mat is sandwiched between two elongated pads made of belting material. The opposite ends of the pads are bolted together through the mat. Needle punch felt having a grass-like appearance is sewn to the top of the top pad and the top pad is recessed into the top face of the base mat. A replaceable tee has a base positioned between the base mat and the top pad and a stem which extends through the top pad. The tee may be easily replaced as required and the top pad is of sufficient size that it protects the mat against wear from hits from golf clubs and if necessary the top pad may be replaced as required.

The top and bottom pads are loosely secured to the mat through their midsections thereby allowing give when struck by a golf club which absorbs energy which might otherwise damage the pad or the mat.

The base mat includes laminations of tufted cut pile spiked turf and foam cushion having polyethylene backing on its top side and nylon fiber on the bottom side thereby giving the mat substantial cushioning and strength. The edging of the mat is sealed by being surged whereby the edge has a knitted or crocheted appearance which prevents any delamination from occurring and gives it a distinctive appearance.

An important feature of the golf mat is the manner in which the mat is strengthened by the addition of a layer of belting or belting-like material in the base mat between the foam cushion and the turf layer of grass-like material. The turf layer includes two sheets of polypropylene primary backing material having aligned holes through which filaments of yarn such as tufts extend. The tufts are U-shaped and are partially exposed on the bottom side of the turf layer. A layer of belting-like material is positioned between the turf and the foam cushion. Woven fabric-like material is embedded in the belting layer with the woven fabric being partially exposed on the top side. Adhesive is applied between the belt-like layer and the turf layer and the adhesive penetrates into both and forms a chemical and mechanical bond therebetween. The tufts are in close proximity or contact with the woven fabric. Adhesive is also applied between the bottom side of the belt-like material and the foam cushion completing the laminated golf mat. It is seen that a strong durable bond has been produced between the turf and the belt-type material which will not be broken by repeated blows from golf clubs. The foam cushion is protected from damage by the belt-like material but yet the benefits of the cushions presence are felt by the golfer.

DESCRIPTION OF THE DRAWINGS

FIG. 13 is a top perspective view of an alternate embodiment of the golf mat of this invention.

FIG. 14 is an exploded perspective view thereof.

FIG. 15 is a fragmentary exploded perspective view of the turf material only.

DESCRIPTION OF THE PREFERRED EMBODIMENT

Figure 1:
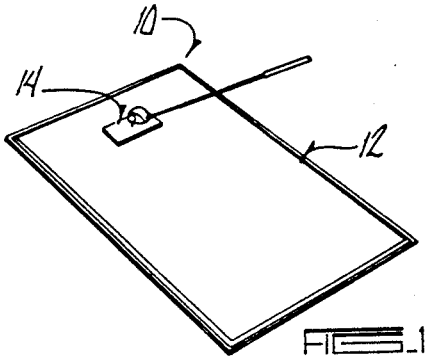
FIG. 1 is a top perspective view of the golf mat of this invention.

The golf mat of this invention is referred to generally in FIG. 1 by the reference numeral 10 and includes a base mat 12 to which top and bottom pads 14 and 16 are secured by a pair of bolt assemblies 18 at each end which extend through the mat 12.

Figure 4:
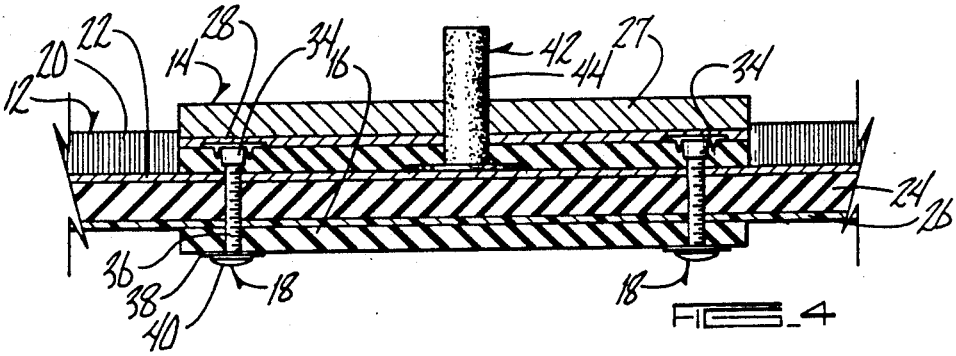
FIG. 4 is a cross-sectional view taken along line 4—4 in FIG. 2.

The mat 12 as seen in FIG. 4 includes a top layer of. tufted cut pile spike turf 20 which gives the grass-like appearance adhesively bonded to a layer of polypropylene backing 22 treated with urethane pre-coat which in turn is adhesively bonded to a layer of sponge rubber 24 which carries a nylon fiber backing 26.

Figure 6:
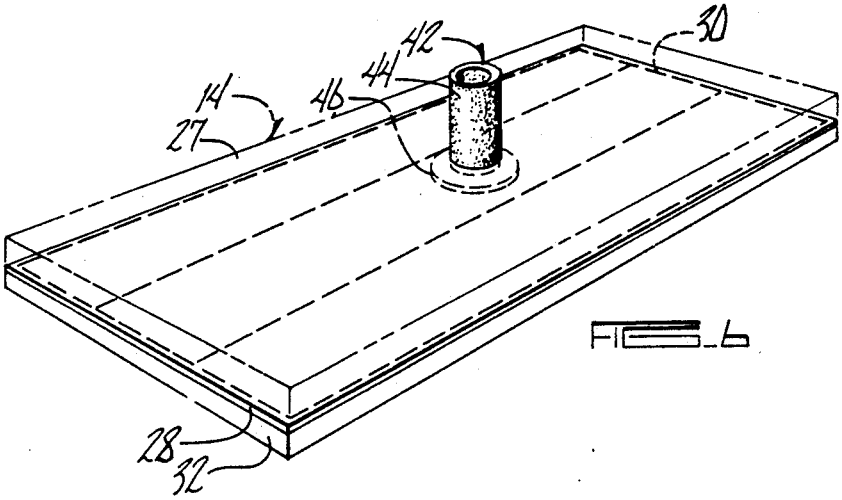
FIG. 6 is a top perspective view of the top pad.
Figure 7:
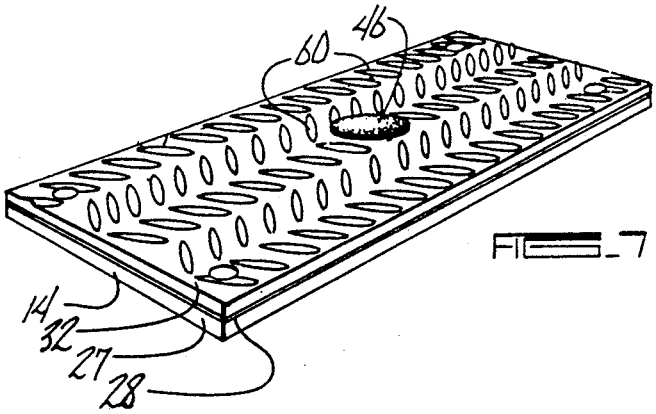
FIG. 7 is a bottom perspective view of the top pad.
Figure 8:
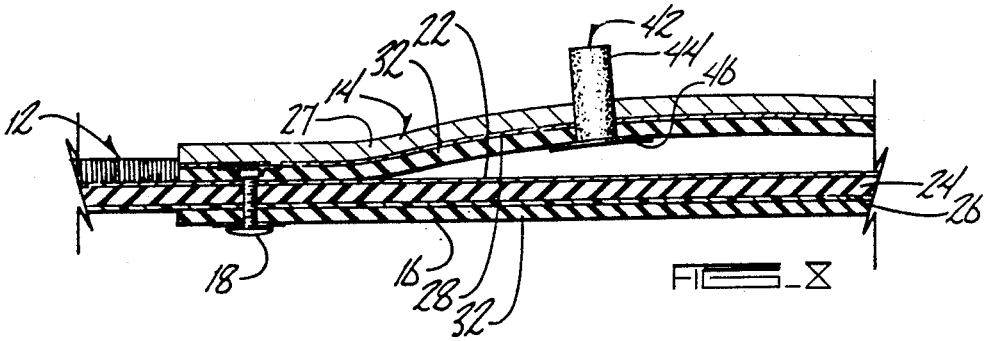
FIG. 8 is a cross-sectional view taken along line 8—8 in FIG. 2 showing the top pad being lifted above the mat for replacing the tee.

The top pad 14 has a top layer 27 of needle punch felt which also gives a grass-like appearance and is secured by adhesive 28 and stitching 30 as seen in FIG. 6 to an elongated strip of durable flexible belting material 32. A T-nut 34 as seen in FIG. 8 is positioned between the belting 32 and the turf 27 of the top pad 14 and receives the bolt 36 from the bottom of the mat. The bottom pad 16 comprises belting 32 and completes the package and is held in place by the bolt assembly 18. A washer 38 is provided against the head 40 of the bolt 36 on the bottom face of the bottom pad 16.

Figure 2:
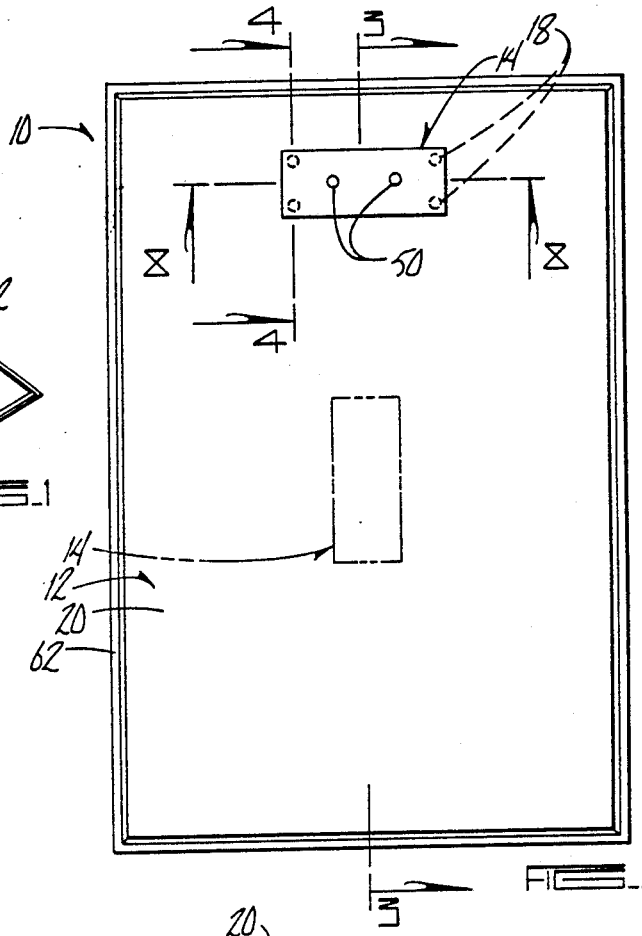
FIG. 2 is a top plan view thereof.
Figure 9:
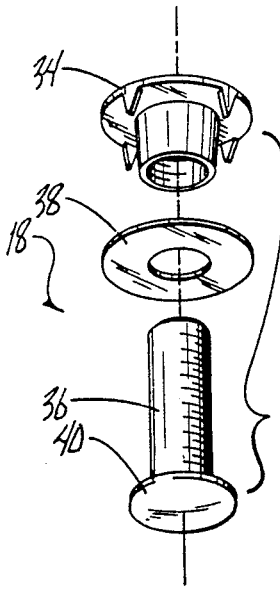
FIG. 9 is an enlarged perspective view of the bolt assembly.

A golf tee 42 having a stem 44 and a base 46 extends through the top pad 14 with the base being positioned between the top of the mat 12 and the bottom of the top pad 14. As seen in FIG. 8 the top pad may be lifted up from the mat 12 to allow the tee 42 to be replaced as required. As seen in FIG. 2 alternate optional holes 50 are provided in the top pad 14 to help distribute the wear on the pad 14. The holes are preferably located approximately 4 inches from the ends of the pad 14.

As seen in FIG. 4 the tufted cut pile spike turf 28 has been shaved away to provide a recessed area having the same area dimensions as the top pad 14 such that the top surface of the top pad 14 is close to being coplanar with the top surface of the base mat 12.

The top and bottom pads 14 and 16 each have on their bottom surfaces a grid of elliptical-shaped shoulders 60 which in the case of the bottom pad 16 help to frictionally secure the mat in place on the ground.

Figure 5:
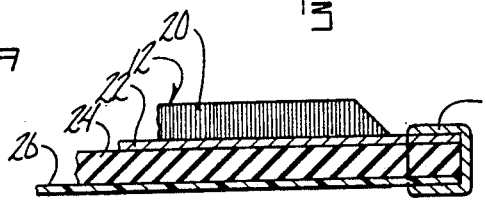
FIG. 5 is an enlarged cross-sectional view of the edge area of the mat indicated in FIG. 3 by the lines 5—5.
Figure 3:
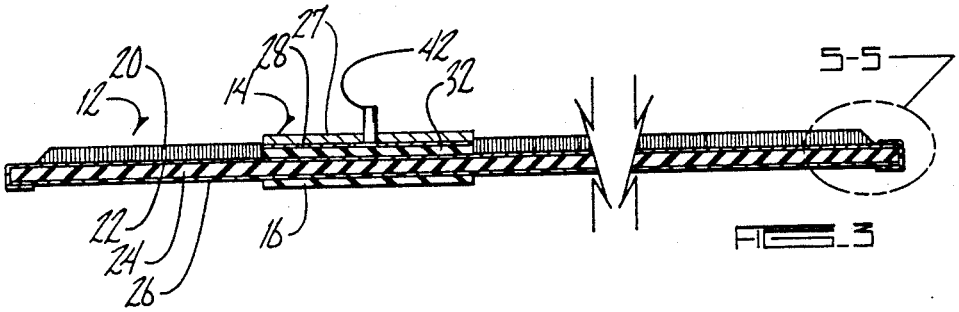
FIG. 3 is a cross-sectional view taken along line 3—3 in FIG. 2.

As seen in FIG. 5 the edge of the mat is surged with endless loops of cord material 62 giving the edge a knitted or crocheted appearance. This surging seals the mat edge and prevents any moisture from getting between the laminations of turf 20 polypropylene backing 22 and nylon fiber backing 26 and the sponge rubber sheet 24.

Thus it is seen in use that the golfer may stand either on the mat 12 or off of it with the golf ball being placed on the tee 42. If the head of the golf club strikes the mat the mat will be protected by the top pad 14 which is of a sufficient area to accept most hits from erratic golfers. The tee 42 would have a tendency to enlarge the hole in the mat in the normal practice golf mat but in this invention the tee does not extend through the mat but only through the top pad 14 which has been substantially strengthened by the use of the belting 32 which is nearly indestructible. The top surface of the top pad 14 including the felt material 27 will be protected and the holes 50 will not be enlarged by the tee 42 even though the tee may be destroyed from repetitive strikes from a golf club. In this case the tee 42 is simply replaced as shown in FIG. 8. The only thing that will eventually wear is the felt carpet 27 of the top pad 14 and this may be replaced if needed by simply removing the bolts 18 and reinstalling a new top pad 14.

The one-half inch foam cushion 24 of the mat 12 is PVC Nitrile sold as Ensolite PGG by Uniroyal, Ensolite Division, Mishawaka, Ind. The needle punch felt carpet material may be obtained from General Felt, Inc., Philadelphia, Pa. The tufted cut pile spike turf is obtained from Instant Turf, Dalton, Ga. The belt material is PVC PVK 120 PC X FS from Georgia Duck and Cordage Mill, Scottdale, Ga. It is a reinforced fabric of nylon with PVC on the top side. The adhesive 28 between the belt 32 and the turf 27 in the top pad 14 is a structural acrylic Versilok 506 from Lord Chemical Corporation, Erie, Pa. Adhesive bonding the cushion 24 to the layer of grass-like material 20 is Tyrite 7650 from Lord Chemical Corporation, Erie, Pa.

Figure 10:
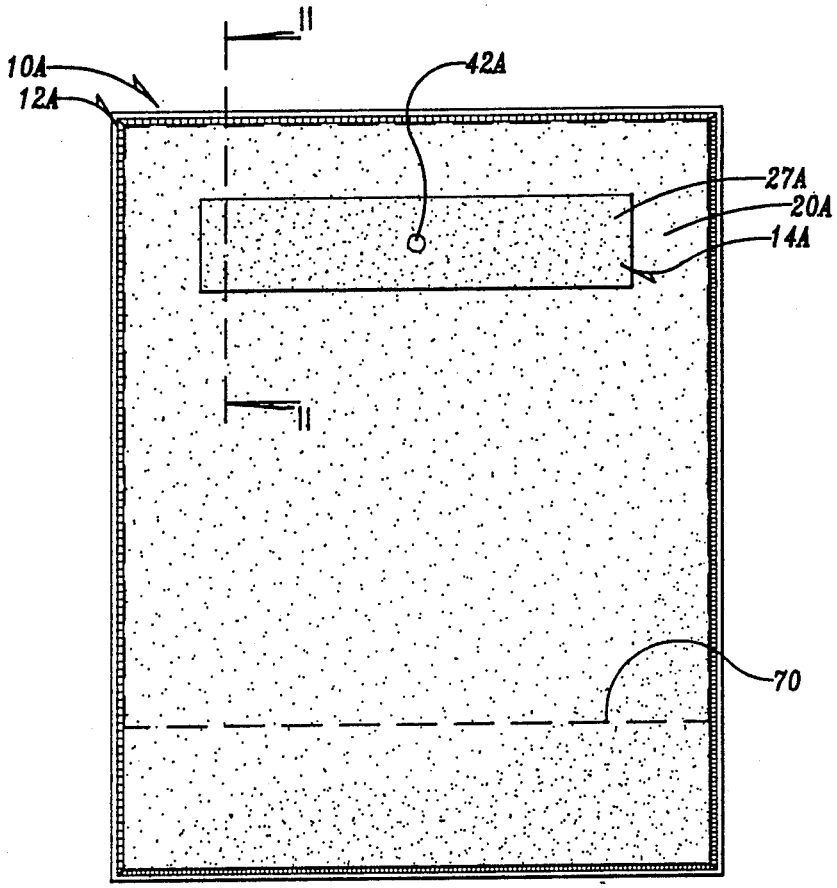
FIG. 10 is a perspective view of an alternate embodiment golf mat.
Figure 11:
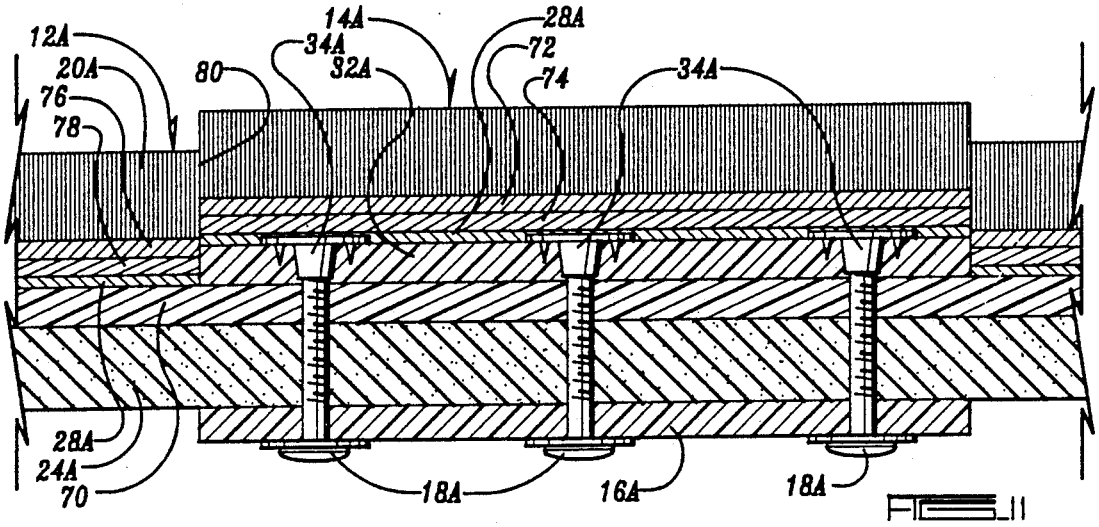
FIG. 11 is a cross-sectional view taken along line 11—11 in FIG. 10.
Figure 12:
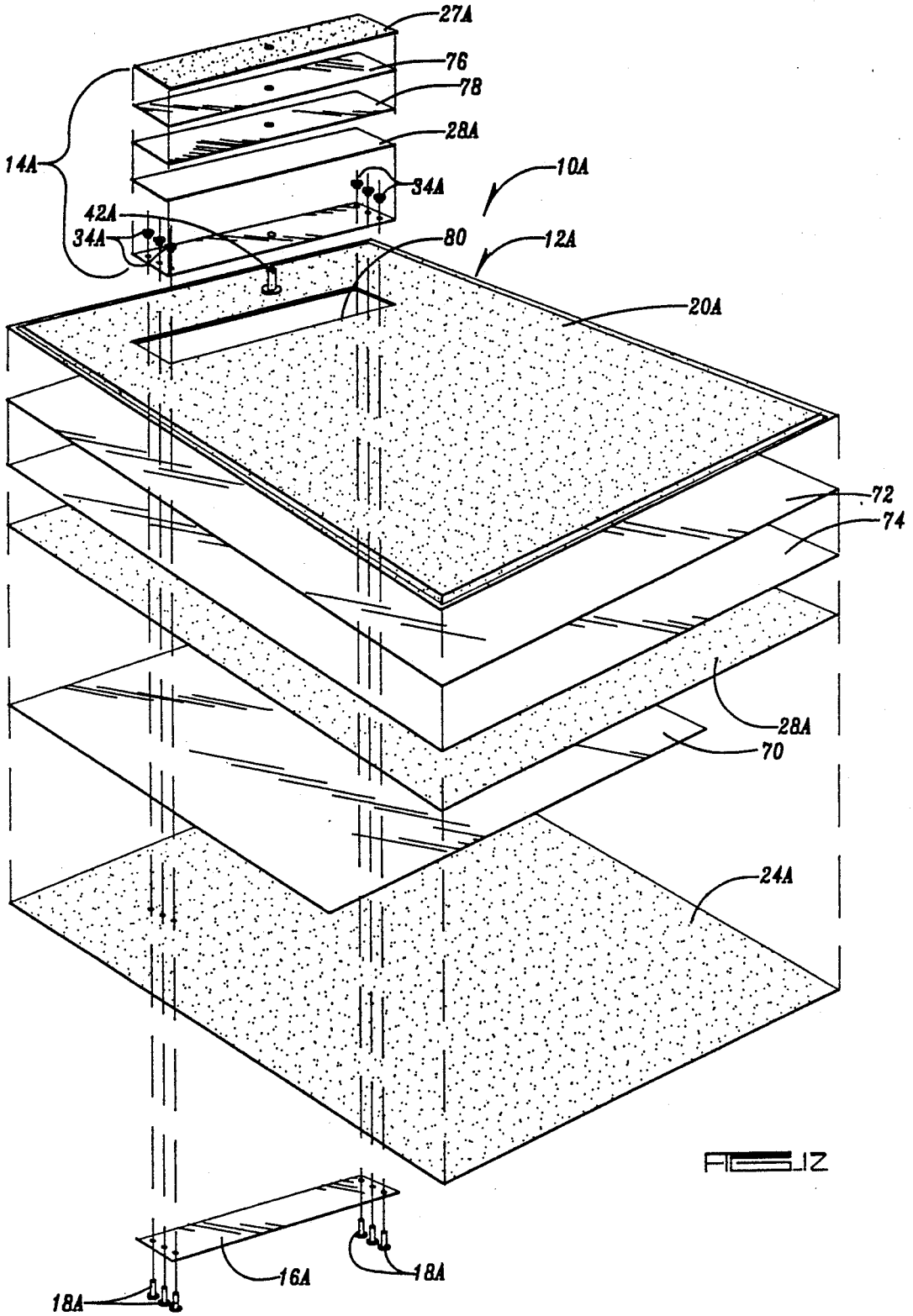
FIG. 12 is an exploded perspective view thereof.

An alternate embodiment 10A is shown in FIGS. 10–12. The primary change is the addition in the base mat 12A of a layer of belt-like material 70 between the cushion 24A and the layer of carpet-like material 20A. This change further strengthens the golf mat against damage. The layer 70 as seen in FIG. 10 does not extend to the lower end of the mat 10A. The main wear is in the center and at the upper end.

Comparable components of the golf mat 10A are referred to by the same reference numeral with the addition of letter "A".

The base mat 12A also includes a layer of grass-like material 20A which has secured and added on its lower or back side primary and secondary backing sheets 72 and 74 of woven fiber polypropylene cross bonded together.

The top pad 14A also includes cross bonded backing sheets 76 and 78 on the back side of the carpet layer 27A. The carpet 27A is bonded to the belt 32A by the adhesive 28A.

It is seen that a recess 80 is cut in the base mat 12A to receive the top pad 14A allowing the belt layer 32A of the top pad 14A to directly engage the belt layer 70 in the base mat 12A.

A further alternate embodiment 10B is shown in FIGS. 13–18 and is a further variation of the embodiment 10A of FIGS. 10–12.

Comparable components of the golf mat 10B are referred to by the same reference numeral with the addition of the letter "B".

The main components of the mat 10B include the layers of turf 20B belt-like material 70B and foam cushion 24B. The layers are bonded together by adhesive 28B.

Figure 16:
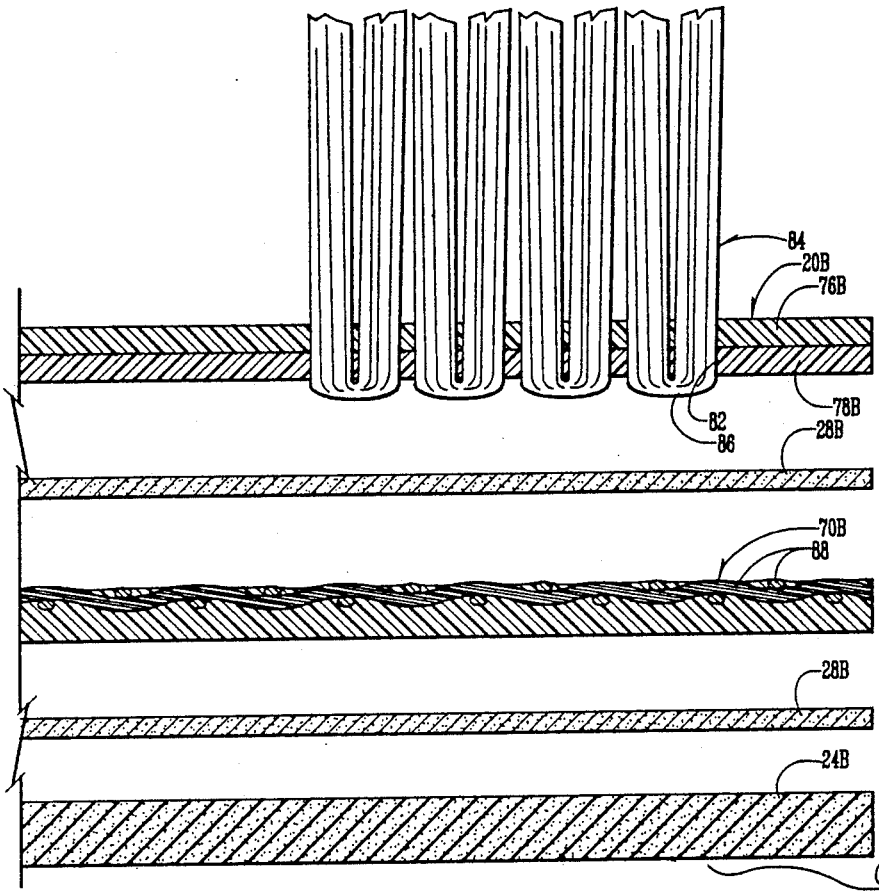
FIG. 16 is a cross-sectional view taken along line 16—16 in FIG. 14.

In FIG. 15 the turf layer 20B is seen to include double primary cross bonded backing sheets 76B and 78B with aligned openings 82 through which polypropylene or nylon tufts 84 are positioned. The backing sheets 76B and 78B are of polypropylene material. In FIG. 16 it is seen that the tufts 84 which are U-shaped have portions 86 partially exposed on the bottom side of backing sheet 78B.

Figure 17:
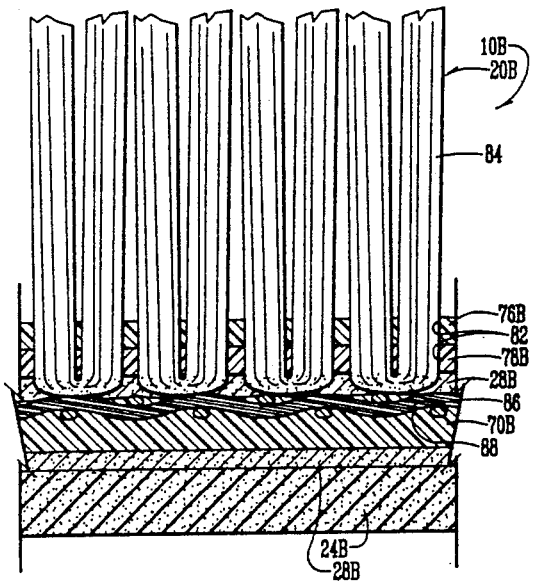
FIG. 17 is an enlarged cross-sectional view illustrating the bond between the turf and belt-like material layers wherein the tufts and woven fabric-like material are mechanically and chemically bonded.

The belting layer 70B includes a layer of woven fabric 88 which is seen to be partially exposed in FIGS. 16 and 17.

Chemical and mechanical bonding of the turf 20B to the belting layer 70B is accomplished through use of the adhesive 28B as seen in FIGS. 16 and 17 wherein the adhesive actually encapsulates the tuft portions 86 and the exposed fabric material 88. The adhesive penetrates into the backing sheets 76B and 78B around the tufts 84 and into the belting material around the fabric 88. This provides the chemical adhesive bond along with a mechanical bond. Knitted turf is an acceptable alternative as it has filaments which extend through the locking material for the adhesive to encapsulate.

Figure 18:
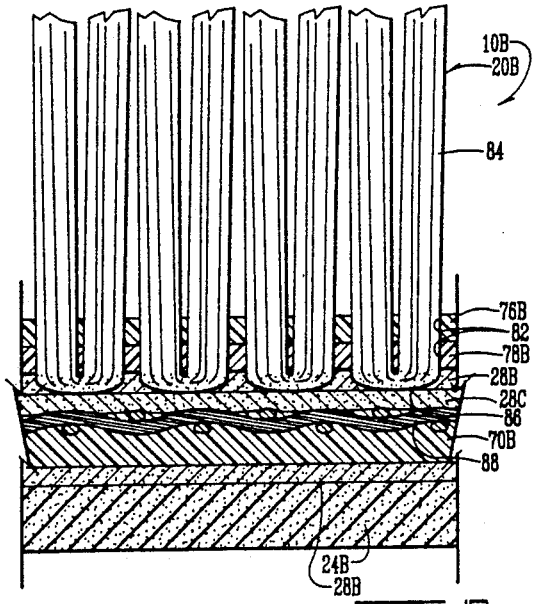
FIG. 18 is a view similar to FIG. 17 but showing a bond where the turf material has been pre-treated with adhesive.

As seen in FIG. 18 a pre-coat of adhesive 28C has been added to the turf 20B In this case the adhesive 28B when applied to the bottom side of the turf 20B penetrates first the pre-coat adhesive 28C and then penetrates the backing sheets 76B and 78B.

By using this procedure tensile tear strengths in excess of 1000 PSI have been obtained. This is approximately 4 times greater than the strength of conventional golf mats. It is thus seen that this invention will resist delamination and dissipates shock because two types of bonding are provided on both layers being laminated.

Conventional golf tees 42B may be used as seen in FIG. 12. These tees may be placed on all four sides of the mat 10B to spread the wear uniformly over the entire mat by simple rotation of the mat as it is being used. The top pad 14A as shown in FIG. 12 for the tee 42B may not be required due to the superior wearability of the mat 10B throughout its entire area.

I claim:

1. A laminated golf mat comprising, a first layer of durable flexible belting-type material having top and bottom sides, woven fabric-like material embedded in said first layer and being partially exposed on the top side of said layer, a second layer of turf having top and bottom sides on the top side of said first layer and said turf having filaments of yarn exposed on the bottom side adjacent the fabric-like material in the top side of said first layer, and adhesive between said first layer and said second layer forming chemical and mechanical bonds between said filaments and fabric material.

2. The structure of claim 1 wherein said filaments are defined by tufts.

3. The structure of claim 1 wherein a cushion layer is adhesively bonded to the bottom side of said first layer.

4. The structure of claim 3 wherein said cushion layer is formed of foam rubber.

5. The structure of claim 1 wherein said layer of turf includes a perforated sheet and said tufts extend through said perforations providing tuft portions on opposite top and bottom sides of said perforated sheet.

6. The structure of claim 5 wherein said tufts are U-shaped and include oppositely disposed interconnected leg portions with free ends, said connection of said legs being on the bottom side of said turf layer and said free ends of said legs being on the top side of said layer of turf.

7. The structure of claim 1 wherein said turf layer bottom side includes a pre-coat of urethane adhesive and said bonding adhesive is a urethane adhesive.

8. The method of making a laminated golf mat comprising the steps of providing a layer of durable flexible belting-type material having top and bottom sides with fabric-type material in belt partially exposed on the top side of said belting-type material, providing a layer of turf material having top and bottom sides and having filaments exposed on said top and bottom sides, positioning said layer of turf material on the top side of said layer of belting-type material such that said filaments on the bottom side of said turf material are in close proximity to said fabric-type material, and applying adhesive between said belting-type layer and said turf layer and forming chemical and mechanical bonds between said filaments and said fabric-type material.

9. The method of claim 8 including the step of positioning a layer of cushion material under said layer of durable flexible belting-type material, and the step of applying adhesive between said belting-type layer and said cushion layer.

* * * * *